US007730932B1

(12) United States Patent
Bauer et al.

(10) Patent No.: US 7,730,932 B1
(45) Date of Patent: Jun. 8, 2010

(54) SCREEN ASSEMBLY

(76) Inventors: Kenneth W. Bauer, 2230 SE. Stonehaven Rd., Port Saint Lucie, FL (US) 34952; Michael Marks, Markschieder Hof 28, Muelheim an der Ruhr D-45481 (DE)

( * ) Notice: Subject to any disclaimer, the term of this patent is extended or adjusted under 35 U.S.C. 154(b) by 322 days.

(21) Appl. No.: 11/503,224

(22) Filed: Aug. 11, 2006

(51) Int. Cl.
*E06B 9/52* (2006.01)

(52) U.S. Cl. ..... 160/369; 160/31; 160/376

(58) Field of Classification Search ..... 160/369, 160/371, 372, 374, 375, 376, 31, 273.1, 381; 49/57, 463
See application file for complete search history.

(56) References Cited

U.S. PATENT DOCUMENTS

| | | | | | |
|---|---|---|---|---|---|
| 1,251,981 | A | * | 1/1918 | Lewis | 160/269 |
| 1,705,132 | A | * | 3/1929 | Norquist et al. | 160/40 |
| 1,722,572 | A | | 7/1929 | Helin | |
| 2,596,438 | A | * | 5/1952 | Rollings | 160/369 |
| 2,612,660 | A | * | 10/1952 | Casey | 49/422 |
| 2,711,789 | A | * | 6/1955 | Boyle et al. | 160/106 |
| RE24,077 | E | | 10/1955 | Ensminger | |
| 2,800,956 | A | | 7/1957 | Xanten | |
| 3,121,922 | A | * | 2/1964 | Niese | 49/63 |
| 3,349,517 | A | | 10/1967 | Johnson | |
| 3,729,045 | A | * | 4/1973 | MacDonald | 160/371 |
| 3,861,081 | A | | 1/1975 | Maskell | |
| 4,161,977 | A | | 7/1979 | Baslow | |
| 4,203,256 | A | | 5/1980 | Mowry | |
| 4,357,978 | A | * | 11/1982 | Keller et al. | 160/41 |
| 4,458,739 | A | * | 7/1984 | Murray et al. | 160/23.1 |
| 4,462,186 | A | * | 7/1984 | Fuller | 49/463 |
| 4,593,737 | A | * | 6/1986 | Clemente | 160/84.06 |
| 4,604,827 | A | | 8/1986 | Hitchins | |
| 4,676,024 | A | | 6/1987 | Rossman | |
| 4,690,195 | A | * | 9/1987 | Taylor | 160/310 |
| 4,706,729 | A | * | 11/1987 | Sixsmith | 160/369 |
| 5,010,943 | A | * | 4/1991 | Boyer | 160/351 |
| 5,469,906 | A | * | 11/1995 | Cason | 160/105 |
| 6,079,475 | A | * | 6/2000 | Morgan et al. | 160/371 |
| 6,167,656 | B1 | | 1/2001 | Devlin et al. | |
| 6,176,050 | B1 | | 1/2001 | Gower | |
| 6,393,777 | B1 | | 5/2002 | Renfrow | |
| 6,412,538 | B1 | * | 7/2002 | Welfonder | 160/271 |
| D465,033 | S | | 10/2002 | Messier et al. | |
| 6,532,703 | B1 | | 3/2003 | Barrens | |
| 6,928,776 | B2 | | 8/2005 | Hornung | |
| 6,998,981 | B1 | | 2/2006 | Montague | |

* cited by examiner

*Primary Examiner*—David Purol
(74) *Attorney, Agent, or Firm*—Simpson & Simpson, PLLC

(57) ABSTRACT

The present invention broadly includes a screen assembly including a U-shaped channel, a plurality of channels, and a plurality of retainer clips. Each channel in the plurality of channels includes respective first and second walls forming an L-shape and a respective third wall hingedly connected to the respective first wall. The respective first, second, and third walls form a U-shape when the respective third wall is in a closed position. The plurality of channels are arranged to receive a screen frame when the respective third wall is in an open position and the plurality of channel elements is arranged to restrain the screen frame when the respective third wall is in the closed position. The plurality of retainer clips is arranged to releasably engage the plurality of channels to maintain the respective third wall in the closed position.

18 Claims, 8 Drawing Sheets

Fig. 4
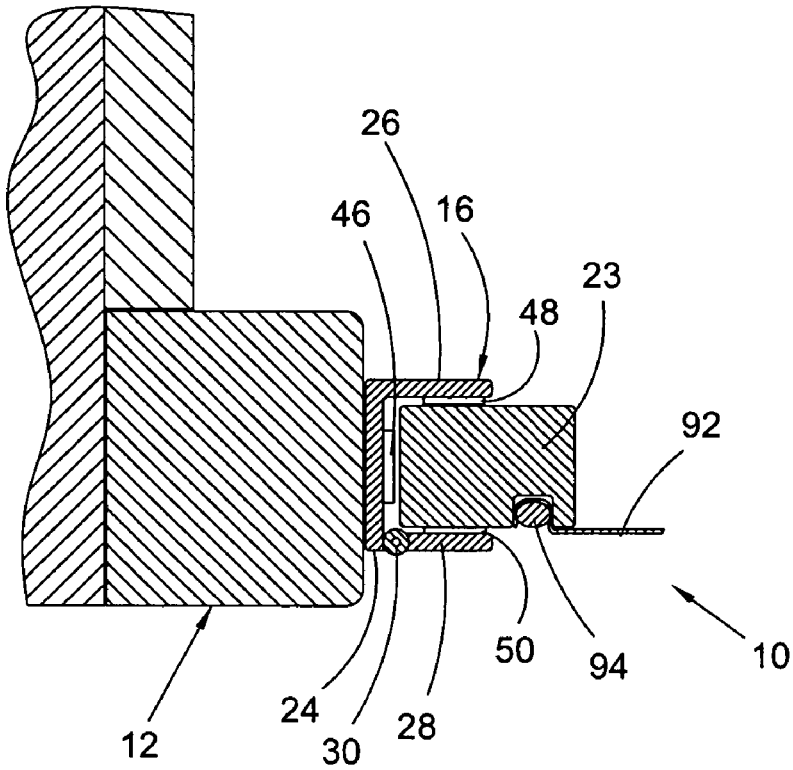
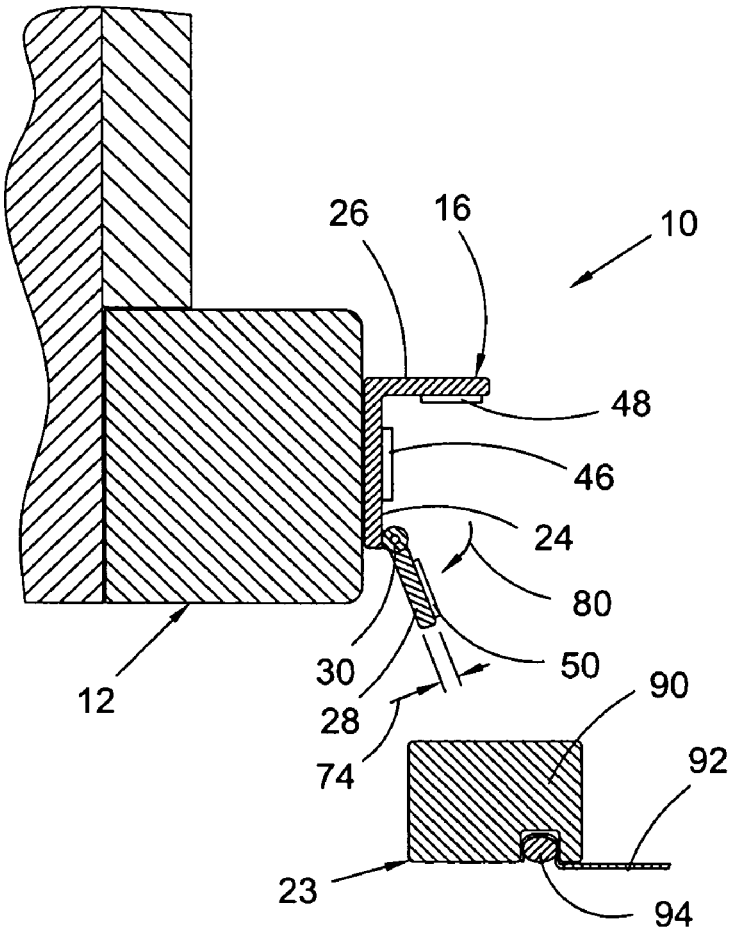
Fig. 5

Fig. 15
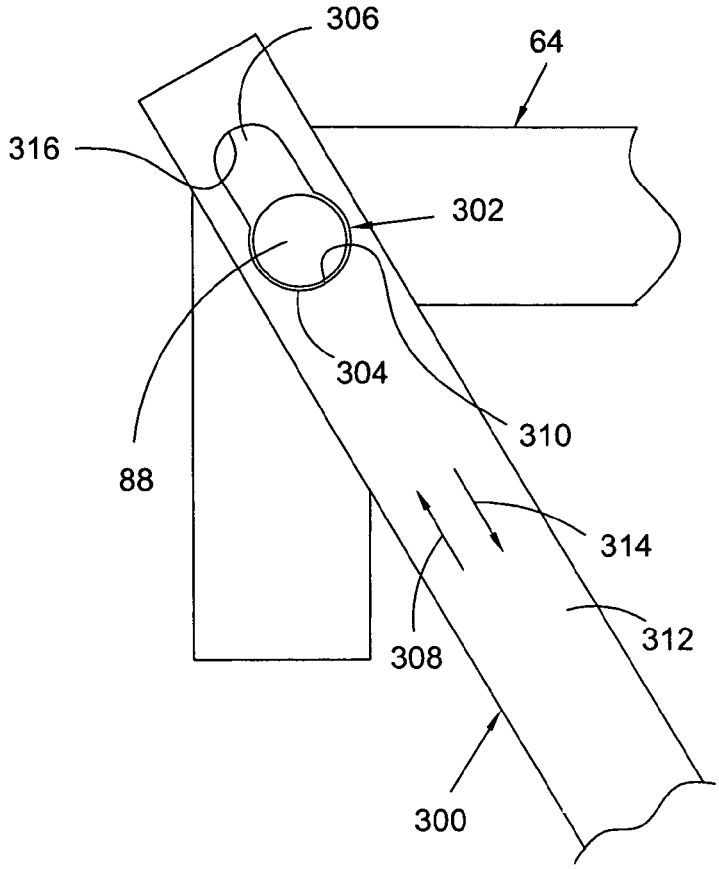
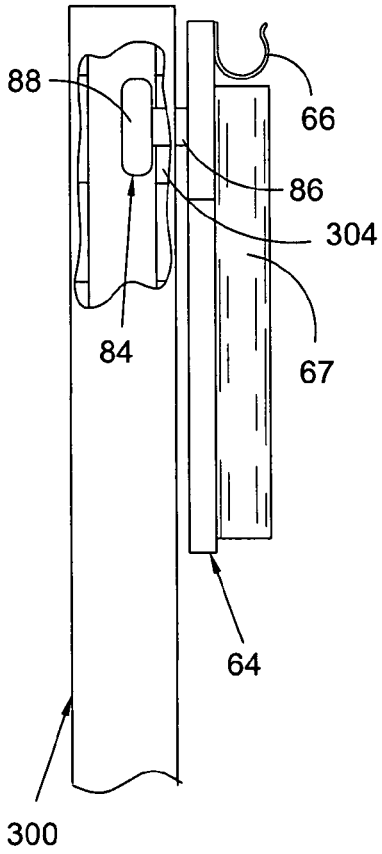
Fig. 17
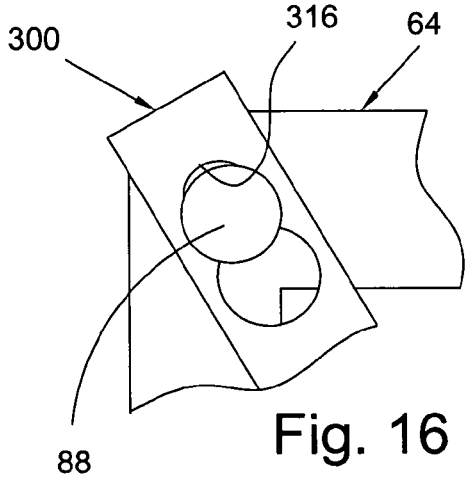
Fig. 16

SCREEN ASSEMBLY

FIELD OF THE INVENTION

The present invention relates generally to a screen assembly, more particularly, to a screen assembly having a series of channels arranged for installation in a window opening and arranged to enable easy insertion and removable of a screen frame. More specifically, some of the channels have hinged walls arranged to retain the screen frame when the hinged walls are in a closed position and release the screen frame when the hinged walls are in an open position.

BACKGROUND

Hurricanes generate high winds that can result in widespread and extensive damage. Damage is particularly prevalent for structures that are not as robust in construction, e.g., screened patios. Even in instances when screened patios are built under strict construction codes, hurricanes carry enough power to severely damage those patios.

Damage to screened structures is in part due to the inherent structure of a screen, i.e., the ratio of air permeable surface area versus air impermeable surface area. Common screens typically have sixty five percent (65%) air permeable surface area and thirty five percent (35%) air impermeable surface area. Thus, in this instance, thirty five percent of the screen's surface area is impermeable to wind and rain, which during a hurricane may exceed sixty miles per hour. It general follows that wind and rain striking this impermeable surface area can impart a large force against the screen thereby causing the screen or a frame attached to the screen to fail.

Further complicating the circumstances is the fact that certain types of debris can effectively turn a screen into sailcloth. Paper or fabric blown about by winds can be pinned against the screen thereby increasing the air impermeable surface area. Additionally, dirt may collect on the screen, increasing the amount of impermeable surface area. In severe situations, dirt may entirely impede all passage of air through the screen. In such situations, a significant amount of pressure may be imparted on the screen and thus the frame of the patio, thereby causing structural damage or collapse.

In addition to the permeability ratio, screens are not resilient to debris and projectiles. Objects thrown about during a hurricane often collide with and subsequently shred screens. For example, screens offer little defense against pieces of wood projected at high speed towards it. In these instances, one of two outcomes is likely to occur, either the screen material fails and becomes shredded or the force of the projectile causes the frame to which the screen material is attached to fail. Either outcome is undesirable as they increase the cost of cleanup and repair after a storm.

Screen assembly designs permit the removal and replacement of screen frames, however this act is often difficult and cumbersome. Often screen frames can be bent or damaged merely by attempting to remove them from the screen assembly. Hence, people are often hesitant to attempt to remove a screen frame, due to the drawbacks present in known screen assemblies.

As can be derived from the variety of devices and methods directed at providing means to remove a screen frame from a screen assembly, many means have been contemplated to accomplish the desired end, i.e., quick and simple screen removal and installation, without sacrificing window aesthetics and cost, and thus resulting in better screen assemblies. Heretofore, tradeoffs between cost and functionality were required. Thus, there has been a longfelt need for a screen assembly that includes means to quickly and easily remove and install a screen frame therein.

BRIEF SUMMARY OF THE INVENTION

The present invention broadly includes a screen assembly including a U-shaped channel, a plurality of channels, and a plurality of retainer clips. Each channel in the plurality of channels includes respective first and second walls forming an L-shape and a respective third wall hingedly connected to the respective first wall. The respective first, second, and third walls form a U-shape when the respective third wall is in a closed position. The plurality of channels are arranged to receive a screen frame when the respective third wall is in an open position and the plurality of channel elements is arranged to restrain the screen frame when the respective third wall is in the closed position. The plurality of retainer clips is arranged to releasably engage the plurality of channels to maintain the respective third wall in the closed position.

In some aspects, the U-shaped channel and the plurality of channels form a closed shape. In some aspects, the closed shape is rectangular. In some aspects, the respective first, second, and third walls form an L-shape when the respective third wall is in the open position. In some aspects, the U-shaped channel and the plurality of channel elements are arranged for installation in a window frame.

In some aspects, the U-shaped channel includes a base piece, two parallel side pieces, and a biasing device arranged to impart a force on the screen frame parallel to the side pieces. In some aspects, the biasing device is a spring or resilient foam. In some aspects, for a first channel in the plurality of channels, the respective third wall is connected to the respective first wall with a hinge. In some aspects, for a second channel in the plurality of channels, the respective third wall is connected to the respective first wall with a segment of flexible material. In some aspects, the respective third wall is integral to the respective first wall.

In some aspects, a channel in the plurality of channels includes at least one pad arranged to frictionally engage the screen frame. In some aspects, a channel in the plurality of channels includes at least one pad arranged to urge the screen frame against another or the same channel.

In some aspects, a clip in the plurality of clips is arranged to releasably engage respective third walls for two channels in the plurality of channels. In some aspects, a clip in the plurality of clips is arranged to releasably engage the U-shaped channel and a respective third wall for a channel in the plurality of channels.

In some aspects, a clip in the plurality of retainer clips includes a protrusion arranged to engage an installation tool. In some aspects, the installation tool comprises an opening arranged to receive the protrusion to disengage the retainer clip from the respective third wall, the installation tool comprises an opening arranged to receive the protrusion to engage the retainer clip with the respective third wall, or the installation tool comprises an opening arranged to receive the protrusion to disengage the clip from the respective third wall and arranged to receive the protrusion and to engage the retainer clip with the respective third wall.

A general object of the invention is to provide a convenient and aesthetically pleasing means to both retain and remove a screen frame from a screen assembly.

These and other objects, features, and advantages of the present invention will become readily apparent to one having ordinary skill in the art upon reading the detailed description of the invention in view of the drawings and appended claims.

BRIEF DESCRIPTION OF THE DRAWINGS

The nature and mode of operation of the present invention will now be more fully described in the following detailed description of the invention taken with the accompanying drawing figures, in which:

FIG. 4 is a cross-sectional view taken generally along line 4-4 of FIG. 1 showing a channel in the assembly of FIG. 1;

FIG. 5 is a cross-sectional view showing the channel of FIG. 4 in an open position with the screen frame removed from the assembly;

FIG. 7 is a front view of a present invention retainer clip shown in

FIG. 6;

FIG. 15 is a front view of the retainer clip shown in FIG. 7 engaged with a present invention installation tool in a first position;

FIG. 16 is a front view of the retainer clip shown in FIG. 7 engaged with an installation tool in a second position; and, FIG. 17 is a side view of the retainer clip and installation tool of FIG. 16.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred embodiment, it is to be understood that the invention as claimed is not limited to the preferred embodiment.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described. Adverting now to the figures.

Figure 1:
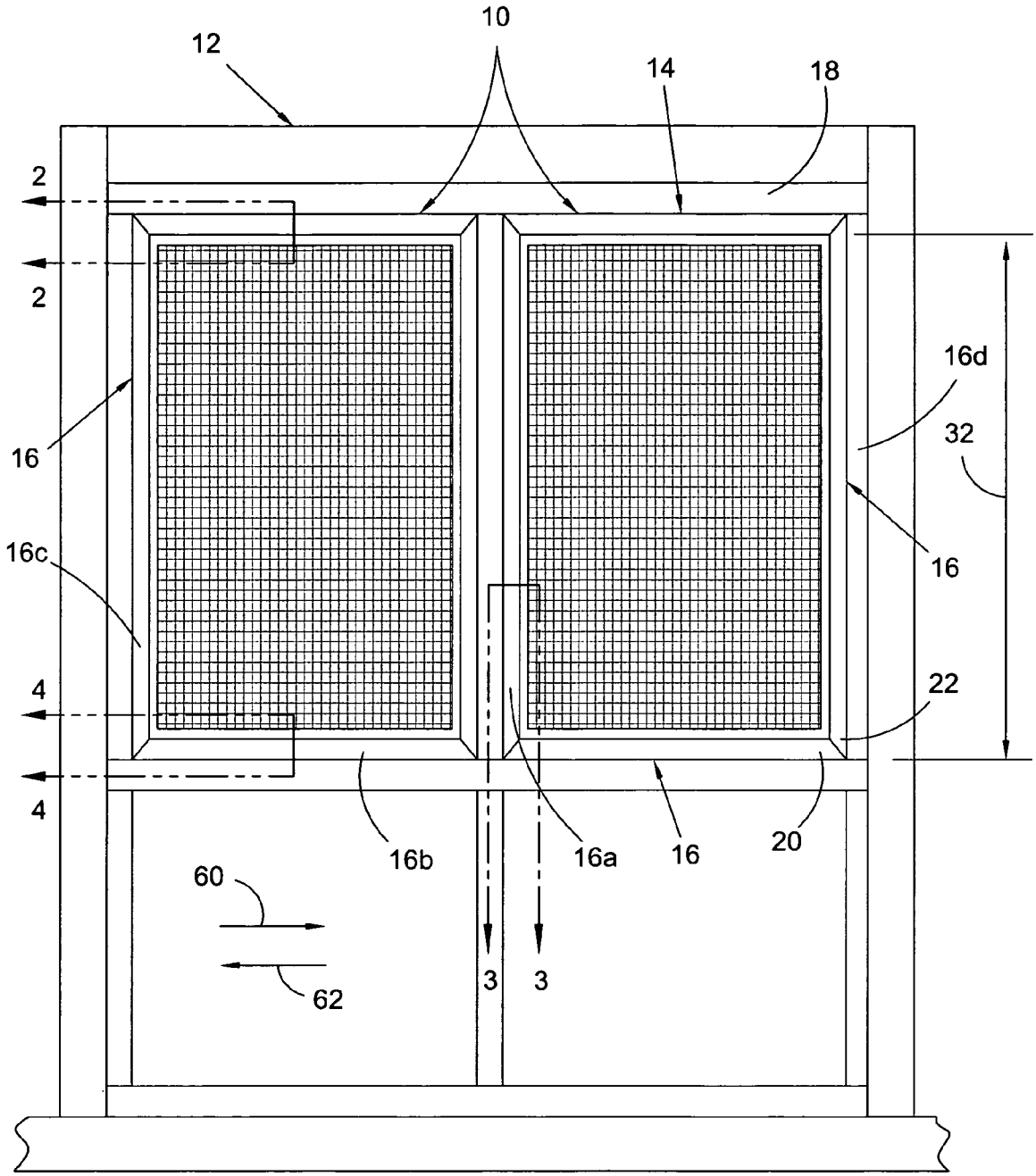
FIG. 1 is a front view of two present invention screen assemblies in a portion of a screened patio.

FIG. 1 is a front view of present invention screen assemblies 10 in a portion of screened patio 12. Assembly 10 includes U-shaped channel 14 and a plurality of channels 16. U-shaped channel 14 and channels 16 form a rectangular shape and are arranged to be installed in an opening, or window. For example, the channels are installed in opening frame 18 in patio 12. In some aspects, channels 14 and 16 form a closed shape, that is, each end of each channel is located in close proximity, if not touching, an end for another channel in assembly 10. For example, end 20 is proximate end 22. In some aspects the closed shape is rectangular. However, is should be understood that any combination of shapes is possible for a closed form. Further, in those aspects in which assembly 10 is not arranged as a closed form, any combination of shapes also is possible.

Figure 2:
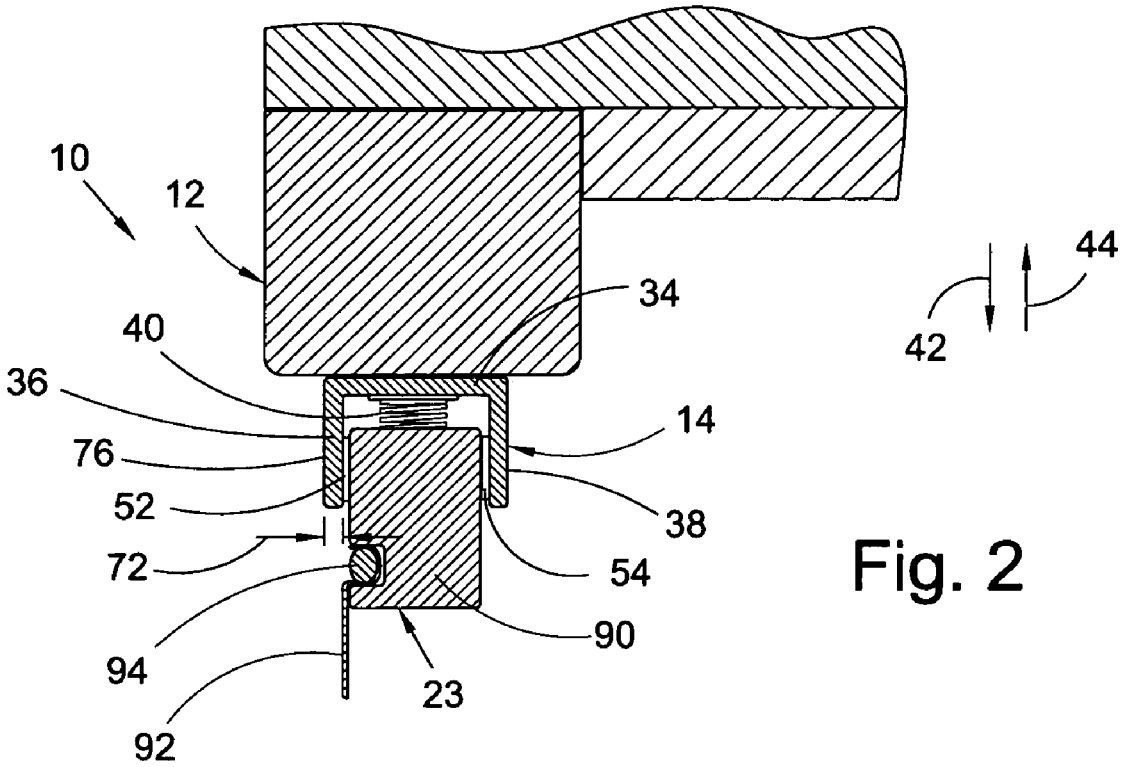
FIG. 2 is a cross-sectional view taken generally along line 2-2 of FIG. 1 showing a U-shaped channel in the assembly of FIG. 1.

FIG. 2 is a cross-sectional view taken general along line 2-2 of FIG. 1 showing U-shaped channel 14 in the assembly of FIG. 1.

Figure 3:
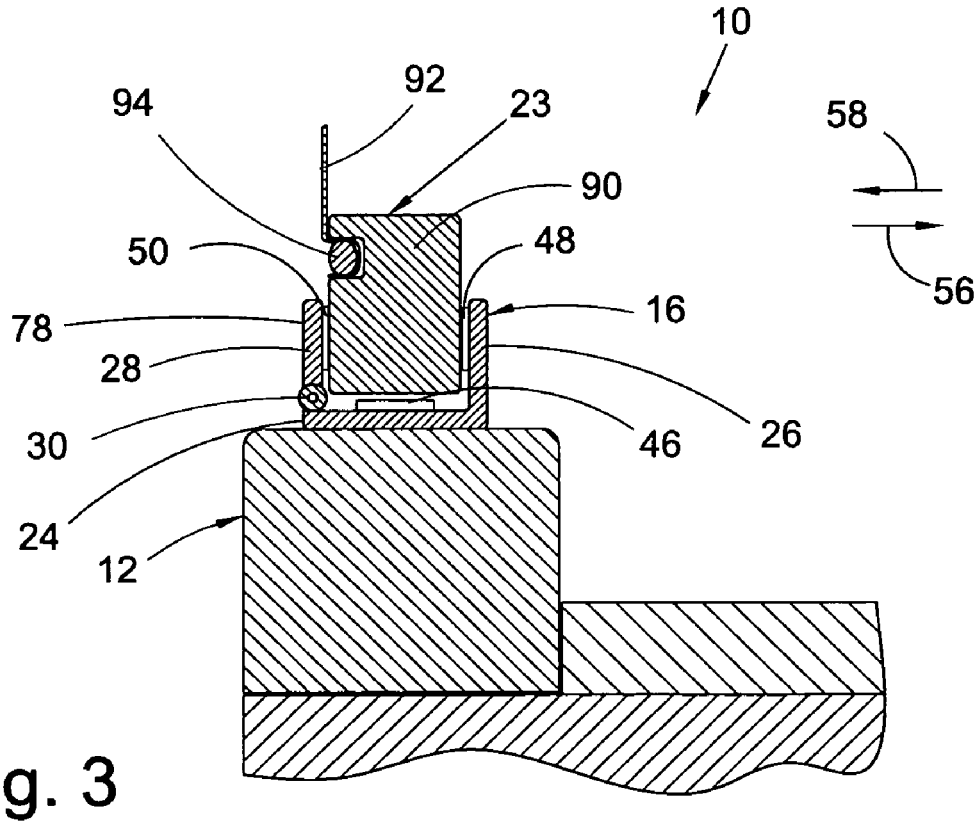
FIG. 3 is a cross-sectional view taken generally along line 3-3 of FIG. 1 showing a channel in the assembly of FIG. 1.

FIG. 3 is a cross-sectional view taken general along line 3-3 of FIG. 1 showing channel 16*a* in the assembly of FIG. 1. The following should be viewed in light of FIGS. 1 through 3. Channels 12 and 14 are arranged to receive window screen frame 23. Each channel 16 includes respective walls 24 and 26 forming an L-shape and respective wall 28. Wall 28 is hingedly connected to wall 24. By hingedly connected, we mean that walls 24 and 28 are connected in some manner such that wall 28 swings with respect to wall 24 along a line disposed between the walls. In some aspects, walls 24 and 28 are connected by hinge 30.

FIG. 4 is a cross-sectional view taken general along line 4-4 of FIG. 1 showing channel 16*b* in the assembly of FIG. 1.

FIG. 5 is a cross-sectional view showing the channel of FIG. 4 in an open position with screen frame 23 removed from the assembly. The following should be viewed in light of FIGS. 1 through 5. Walls 24, 26, and 28 form a U-shape when wall 28 is in a closed position, as shown in FIGS. 3 and 4. Channels 16 are arranged to form an L-shape and receive screen frame 23 when the respective third walls are in an open position, as shown in FIG. 5 and further described below. Channels 16 are arranged to restrain screen frame 23 when respective wall 28 is in the closed position.

The following describes a typical installation of frame 23 in assembly 10. Once channels 14 and 16 are installed in a frame opening, for example, frame 18, walls 28 are placed in the open position. Then, frame 23 is inserted into channel 14 and following that, inserted into the assembly to contact channels 16. In some aspects, distance 32 is less than a length for frame 23. Once the frame is engaged with channels 14 and 16, walls 28 are swiveled into the closed position.

U-shaped channel 14 includes base piece 34 and parallel side pieces 36 and 38. In some aspects, channel 14 also includes biasing device 40 arranged to impart a force on said screen frame in direction 42, parallel to the side pieces. The force in direction 42 pushes frame 23 against the channel opposite channel 14, for example, channel 16*b*, stabilizing the frame within the assembly and preventing frame 23 from easily moving in directions 42 or 44 once the frame is installed and walls 28 are placed in the closed position. Device 40 can be any biasing means known in the art. For example, device 40 can be a coil spring, or any other type of spring, such as a leaf spring. In some aspects (not shown), device 40 is a resilient material, such as foam.

In some aspects, channels 14 and 16 include pads to frictionally and/or compressively engage frame 23. For example, channels 16 can include pads 46 disposed on walls 24, pads 48 disposed on walls 26, or pads 50, disposed on walls 28; and channel 14 includes pads 52 or 54 on walls 36 and 38, respectively. The frictional or compressive engagement stabilizes the frame in the assembly. For example, pads 48 and 50 in channels 16*c* and 16*d* can act to limit the movement of frame 23 in directions 56 and 58 or pad 46 in channel 16*b* can react to the pressure exerted by device 40. Also, pads 46 in channels 16*c* and 16*d* can act to limit the movement of frame 23 in directions 60 and 62. Thus, the pads can urge the frame against a channel different than the channel on which the pad is disposed, or the pads can urge the frame against the same channel on which the pad is disposed.

Figure 6:
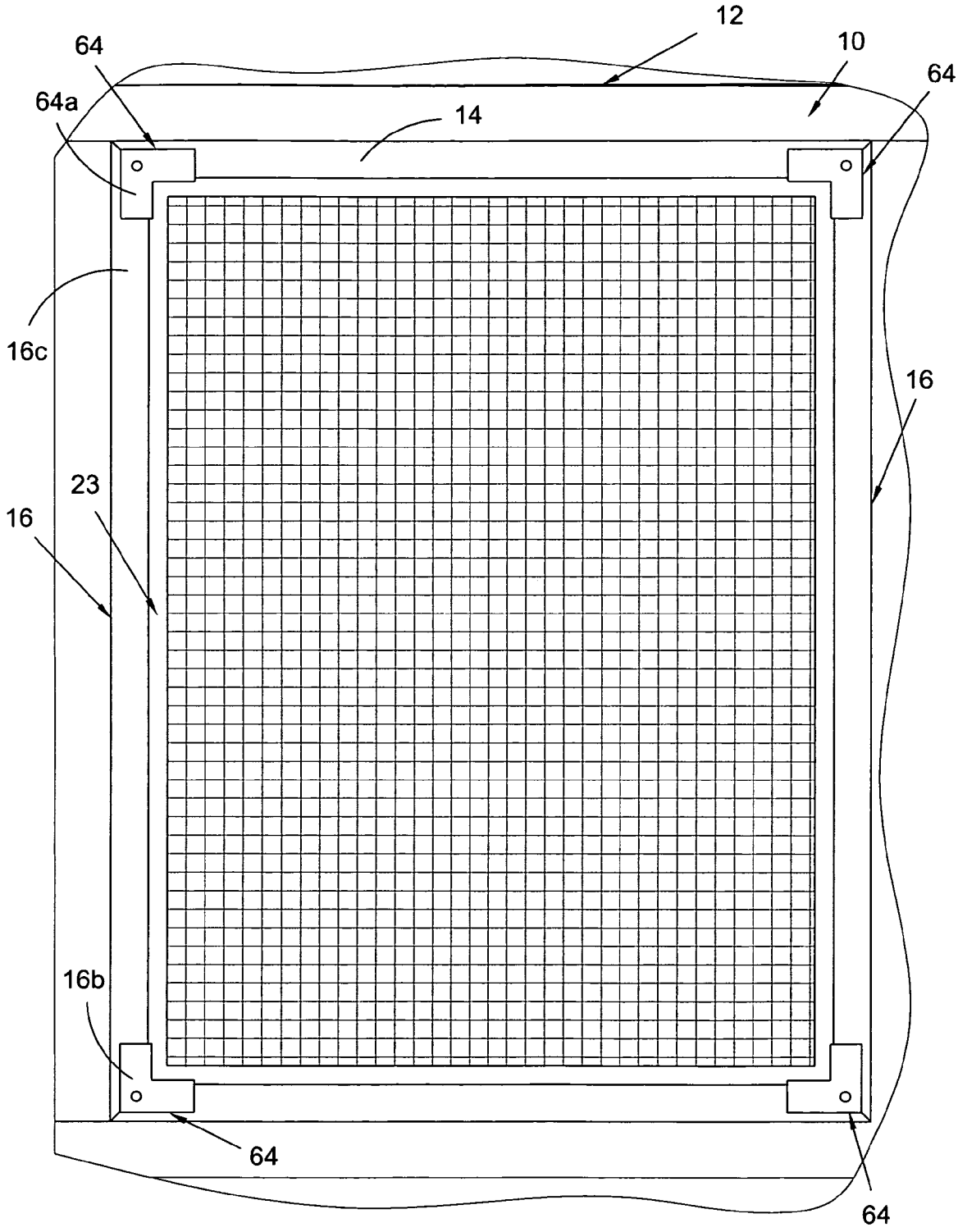
FIG. 6 is a front view of the present invention screen assembly shown in FIG. 1 with retainer clips.

FIG. 6 is a front view of present invention screen assembly 10 shown with retainer clips 64.

Figure 7:
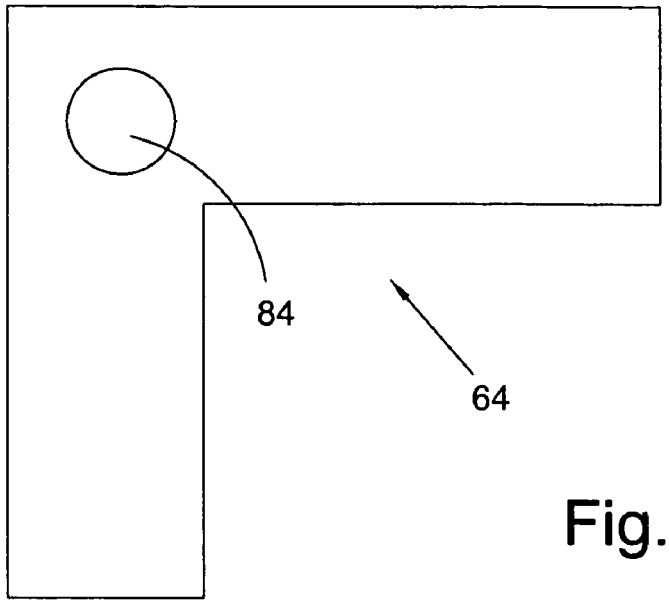
Figure 8:
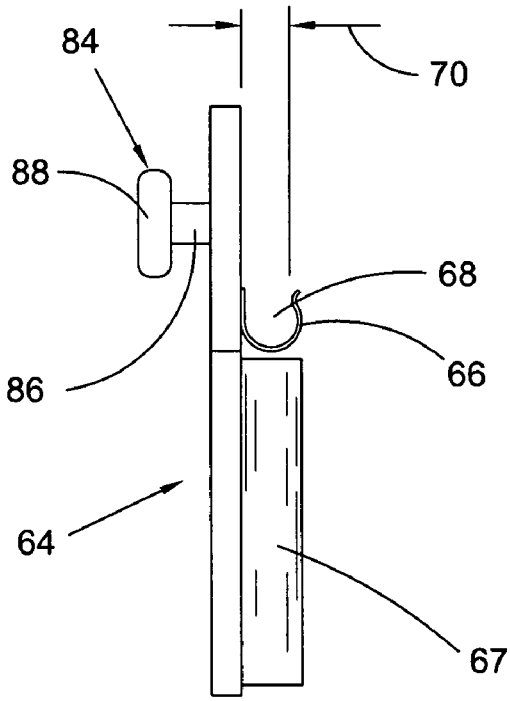
FIG. 8 is a right side view of the retainer clip shown in FIG. 7.
Figure 9:
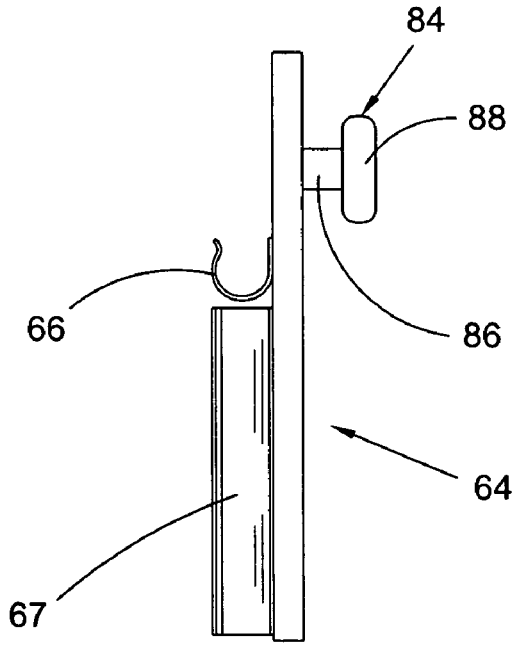
FIG. 9 is a left side view of the retainer clip shown in FIG. 7.

FIGS. 7 through 9 are a front view and right and left side views, respectively, of present invention retainer clip 64 in FIG. 6. The following should be viewed in light of FIGS. 1 through 9. Clips 64 are arranged to releasably engage channels 14 and 16 to maintain walls 28 in the closed position. By releasably engage, we mean that the clips can be attached to the channels, but also can be removed from the channels. The clips include connecting means 66 and 67. In some aspects, the connecting means are resilient pieces. Any resilient means known in the art can be used, including, but not limited to springs. For example, assuming FIGS. 7 through 9 are clip 64*a*, means 66 includes opening 68, which is slid over wall 36 of channel 14. Opening width 70 is less than thickness 72 of wall 36, so that means 66 compressively and frictionally engages wall 36. In like manner for clip 64*a*, means 67 engages wall 28 of channel 16*c*. Assuming that FIGS. 7 through 9 are clip 64*b*, means 66 compressively and frictionally engages wall 28 of channel 16*c* and means 67 compressively and frictionally engages wall 28 of channel 16*b*. That is, distance 70 is less than thicknesses 74 for walls 28 of the channels.

Clips 64 act to prevent walls 28 from swiveling about the hinged attachment, for example, hinge 30, connecting walls 28 with respective walls 24. For example, clip 64*a* is attached to channel 14 and channel 16*b*, causing the clip to be in contact with, or parallel with, surfaces 76 and 78, respectively. The force exerted by means 66 and 67 enables the clip to resist the opening movement of walls 28, for example, in direction 80 in FIG. 5. For example, the clip strives to maintain a planar relationship between channel 14 and adjoining channels 16 and between adjoining channels 16, keeping channels 16 in a closed position and restraining frame 23 within assembly 10.

Figure 10:
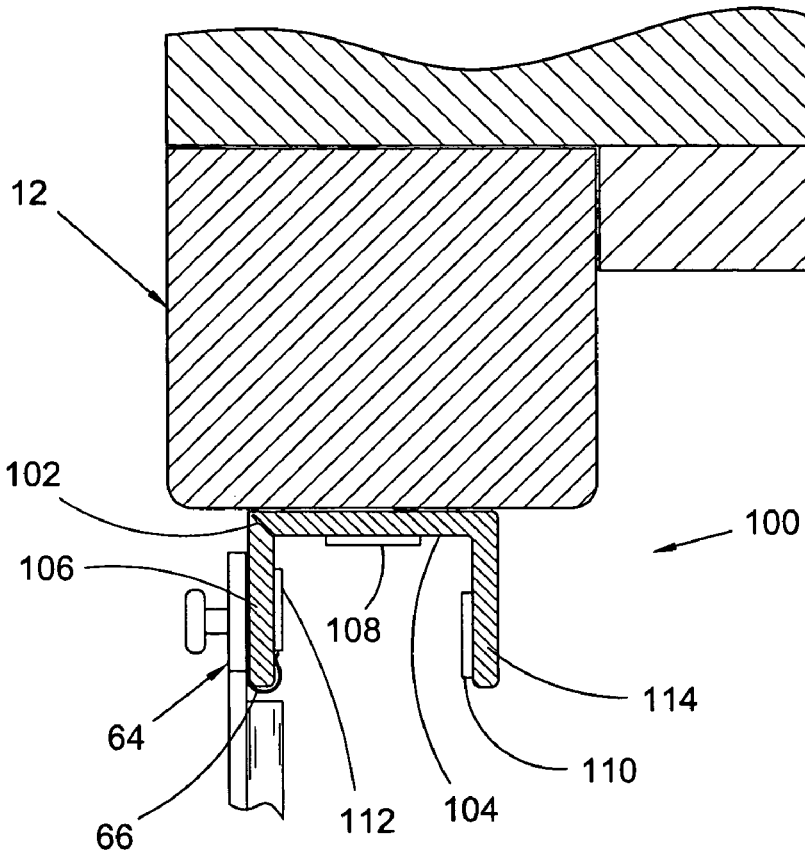
FIG. 10 is a cross-sectional view of a present invention channel with a flexible hinge in a closed position and a present invention retainer clip.

FIG. 10 is a cross-sectional view of a present invention channel 100 with flexible hinge 102 in a closed position and clip 64.

Figure 11:
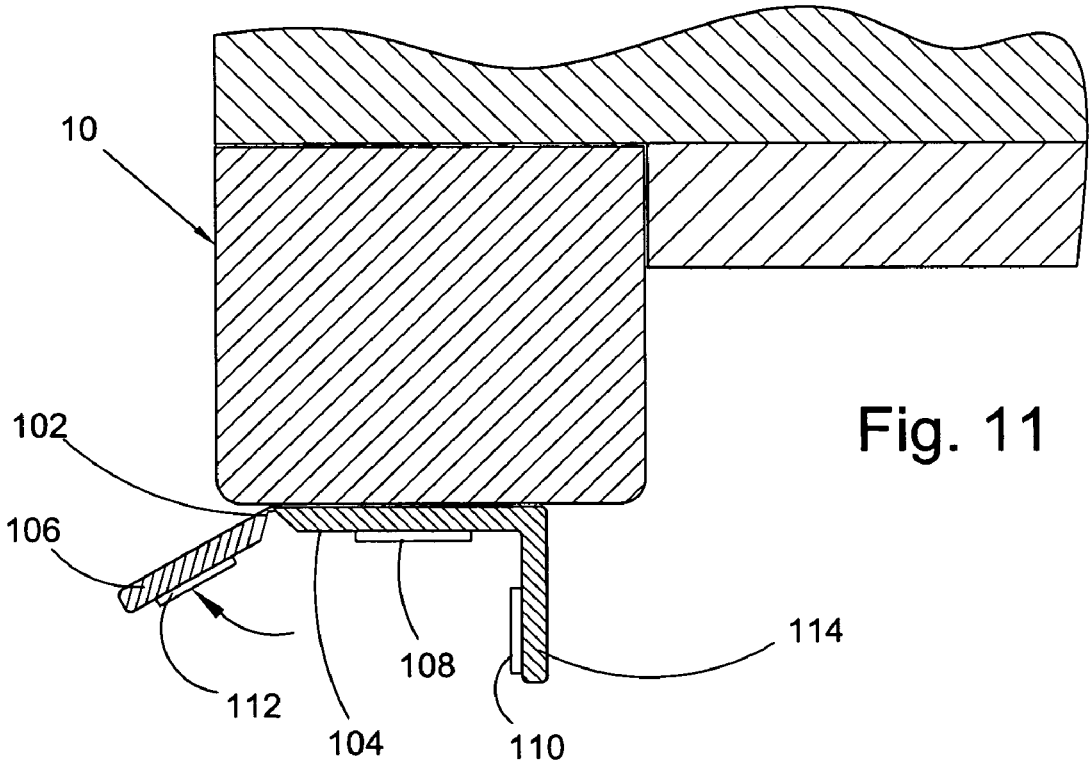
FIG. 11 is a cross-sectional view of the channel of FIG. 10 in an open position.

FIG. 11 is a cross-sectional view of channel 100 of FIG. 10 in an open position. The following should be viewed in light of FIGS. 7 through 11. In some aspects, walls 104 and 106 of channel 100 are connected by a segment of flexible material. In some aspects, segment 102 is integrally formed with both walls, that is, both walls and the segment are formed from a single piece of material. The material is reduced in thickness at the joint between the walls, rendering the reduced area sufficiently flexible to act as a hinge. Pads 108, 110, and 112, on walls 104, 114, and 106, respectively correspond in function to the pads shown supra (reference designators 46, 48, and 50, respectively, in FIGS. 4 and 5). It should be understood that walls 104 and 106 and segment 102 can be formed of any material known in the art, including, but not limited to plastic.

In FIG. 10, clip 64 is shown attached to channel 114, specifically, to front wall 106. As described supra, retaining means 66 has expanded to compressively and frictionally engage wall 36.

Figure 12:
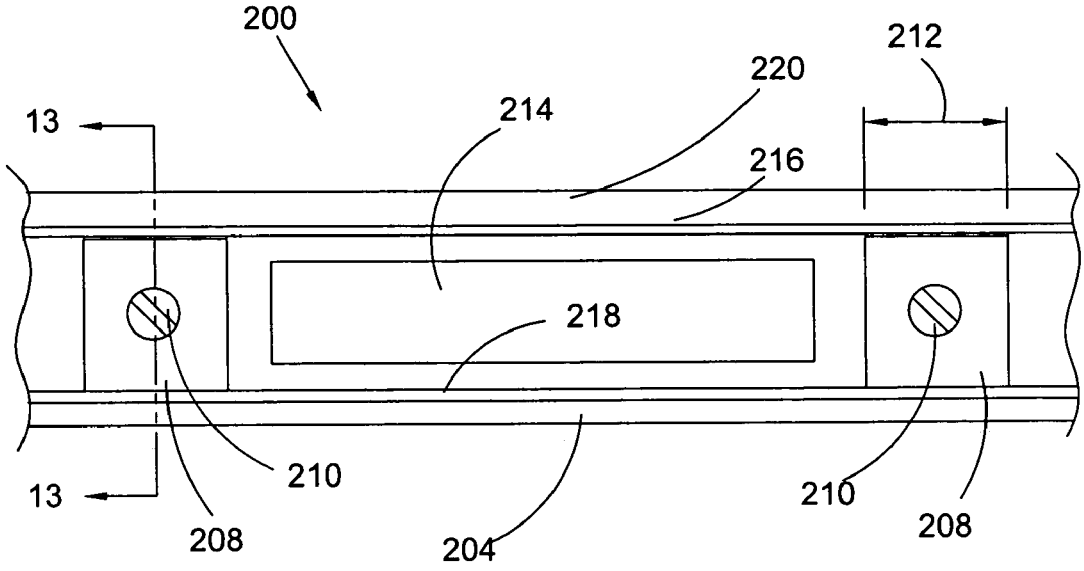
FIG. 12 is a top view of a present invention channel in a closed position.

FIG. 12 is a top view of present invention channel 200 in a closed position.

Figure 13:
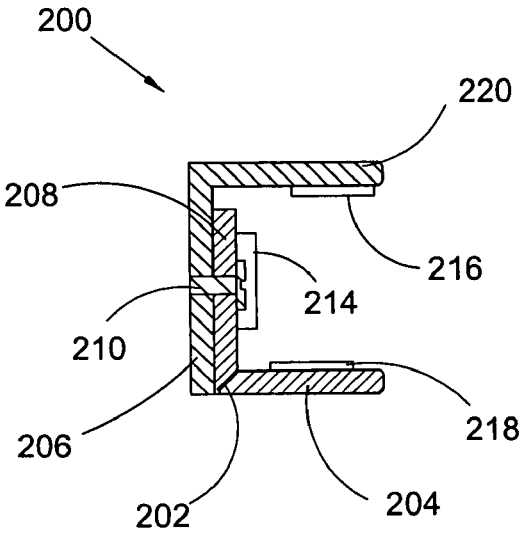
FIG. 13 is a cross-sectional view taken general along line 13-13 of FIG. 12.

FIG. 13 is a cross-sectional view taken general along line 13-13 of FIG. 12.

Figure 14:
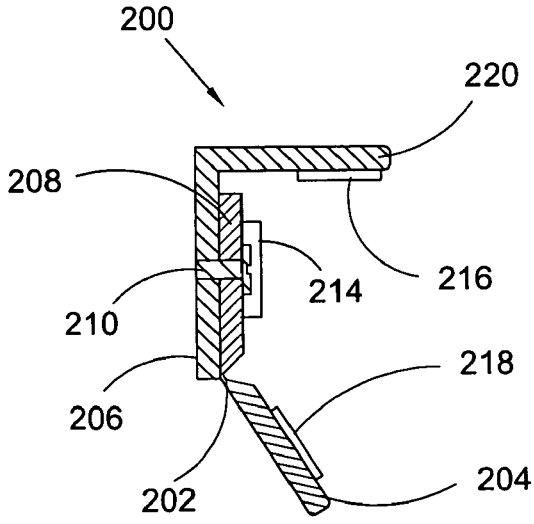
FIG. 14 is the cross-sectional view shown in FIG. 13 with the channel in an open position.

FIG. 14 is the cross-sectional view shown in FIG. 13 with channel 200 in an open position. The following should be viewed in light of FIGS. 12 through 14. In some aspects, flexible hinge segment 202 is integral to wall 204 and joined to wall 206. In particular, portion 208 is secured to wall 206 using any means known in the art, including, but not limited to screws 210. Wall 204, portion 208 and segment 202 function similarly to the flexible hinge arrangement described supra (reference indicators 106, 104, and 102, respectively in FIGS. 10 and 11). Portions 208 can be discrete segments along wall 206 as shown in the figures or (not shown) portion 208 can be formed as a single piece, for example, a single piece with a length substantially equal to the length of wall 206.

It should be understood that channel 200 is not limited to any particular number of portions 208 or any size of portions 208, for example, length 212 of discrete portions 208 is not limited to any particular value. Further, portions 208 having different lengths 212 can be used with a same channel 200. It also should be understood that a present invention assembly can have channels 200 with any combination of discrete or one-piece portions 208. Pads 214, 216, and 218, on walls 206, 220, and 204, respectively correspond in function to the pads shown supra (reference designators 46, 48, and 50, respectively, in FIGS. 4 and 5). It should be understood that wall 204, portion 208 and segment 202 can be formed of any material known in the art, including, but not limited to plastic. In some aspects (not shown), a flexible segment is separately formed from walls 204 and segment 208 and joined to the wall and segment using any means known in the art.

FIG. 15 is a front view of retainer clip 64 shown in FIG. 7 engaged with installation tool 300 in a first position.

FIG. 16 is a front view of retainer clip 64 shown in FIG. 7 engaged with installation tool 300 in a second position.

FIG. 17 is a side view of retainer clip 64 and installation tool 300 of FIG. 16. The following should be viewed in light of FIGS. 1 through 9 and 15 through 17. Clip 64 is shown free-standing in FIGS. 15 through 17 to simplify the presentation, however, it should be understood that in practice clip 64 is interfaced with a present invention assembly by tool 300. FIGS. 15 through 17 show a configuration associated with clip 64*a* in FIG. 6, however, it should be understood that the same general description applies to other clip positions or configurations. In some aspects, clip 64 includes protrusion 84 arranged to engage installation tool 300. Tool 300 is used to engage clip 64 with a present invention assembly, disengage clip 64 with a present invention assembly, or both. Protrusion 84 includes neck 86 and knob 88. Opening 302 includes portion 304 having a diameter larger than the diameter of knob 88 and slot 306 having a width greater than the diameter of neck 86.

To install the clips on a present invention assembly, for example assembly 100, tool 300 is placed over clip 64, as shown in FIG. 15, such that the knob passes through portion 304 and the knob extends past tool 300 aligning neck 86 with opening 302. As tool 300 is moved in direction 308, neck 86 contacts edge 310 of opening 302, the knob overlaps surface 312 of the tool, and the tool and clip move together in direction 308. Means 66 and 67 are brought into contact with walls 36 and 28, respectively and continued movement overcomes the resiliency of the means so that the means engage the walls as described supra.

To remove clips 64 from a present invention assembly, for example, assembly 100, tool 300 is placed over clip 64, as shown in FIG. 15, such that the knob passes through portion 304 and the knob extends past tool 300 aligning neck 86 with opening 302. As tool 300 is moved in direction 314, neck 86 contacts edge 316 of opening 302, the knob overlaps surface 312 of the tool, slot 306 further restricts movement of the tool with respect to the clip, and the tool and clip move together in direction 314. FIGS. 16 and 17 show neck 86 just prior to contact with edge 316. In direction 314, tool 300 pulls the clips away from walls 36 and 28 until means 66 and 67, respectively, disengage from the walls.

The discussion above regarding tool 300 is directed to a clip installed along the top of a present invention assembly, for example, clip 64*a* in FIG. 6. It should be understood that tool 300 also can be used for clips in bottom positions, for example, clip 64*b* in FIG. 6.

Thus, tool 300 enables a user to reach clips that may otherwise be out of reach and helps avoid the use of ladders or other devices that may complicate installation of the clips or create potential safety hazards. Further, the use of the tool creates extra leverage and grip for users, which can be particularly useful for users having diminished strength or dexterity.

A present invention assembly is not limited to use with any particular size, shape, or configuration of screen frame 23, as long as the dimensions of the frame are compatible with the assembly. For example, stock piece 90 and screen 92 can be of any material and configuration known in the art. Screen 92 can be fastened to the stock piece by any means known in the art, including, but not limited to, bead 94.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed:

1. A screen assembly comprising:

a U-shaped channel;

a plurality of channels, wherein each channel in said plurality of channels includes respective first and second walls forming an L-shape and a respective third wall hingedly connected to said respective first wall, said respective first, second, and third walls forming a U-shape when said respective third wall is in a closed position, said plurality of channels arranged to receive a screen frame when said respective third wall is in an open position, and said plurality of channel elements arranged to restrain said screen frame when said respective third wall is in said closed position and wherein the screen frame is a separate piece from the U-shaped channel and the plurality of channels and is insertable in and removable from the U-shaped channel and the plurality of channels when the respective third wall is in the open position, wherein the U-shaped channel and the plurality of channels are adapted to be installed in an opening and wherein the U-shaped channel and the plurality of channels are adapted to remain in a substantially fixed position in the opening when the screen frame is inserted in or removed from the U-shaped channel; and, a plurality of retainer clips arranged to releasably engage said plurality of channels to maintain said respective third wall in said closed position, wherein at least one retainer clip from the plurality of retainer clips is a separate piece from the U-shaped channel and the plurality of channels, wherein each clip from the at least one retainer clip from the plurality of retainer clips is adapted to engage the U-shaped channel and a channel from the plurality of channels or is adapted to engage two channels from the plurality of channels, and wherein each clip from the at least one retainer clip from the plurality of retainer clips includes a protrusion adapted to engage an outer circumferential surface for the screen frame.

2. The screen assembly of claim 1 wherein said U-shaped channel and said plurality of channels form a closed shape.

3. The screen assembly of claim 1 wherein said closed shape is rectangular.

4. The screen assembly of claim 1 wherein said respective first, second, and third walls form an L-shape when said respective third wall is in said open position.

5. The screen assembly of claim 1 wherein said U-shaped channel and said plurality of channel elements are arranged for installation in a window frame.

6. The screen assembly of claim 1 wherein said U-shaped channel further comprises a base piece, two parallel side pieces, and a biasing device arranged to impart a force on said screen frame parallel to said side pieces.

7. The screen assembly of claim 6 wherein said biasing device is a spring.

8. The screen assembly of claim 6 wherein said biasing device is resilient foam.

9. The screen assembly of claim 1 wherein for a first channel in said plurality of channels, said respective third wall is connected to said respective first wall with a hinge.

10. The screen assembly of claim 1 wherein for a second channel in said plurality of channels, said respective third wall is connected to said respective first wall with a segment of flexible material.

11. The screen assembly of claim 10 wherein said respective third wall is integral to said respective first wall.

12. The screen assembly of claim 1 wherein a third channel in said plurality of channels further comprises at least one first pad arranged to frictionally engage said screen frame.

13. The screen assembly of claim 1 wherein a fourth channel in said plurality of channels further comprises at least one second pad arranged to urge said screen frame against a fifth channel in said plurality of channels.

14. The screen assembly of claim 13 wherein said fourth and fifth channels are a same channel.

15. The screen assembly of claim 1 wherein a first clip in said plurality of clips is arranged to releasably engage respective third walls for sixth and seventh channels in said plurality of channels.

16. The screen assembly of claim 1 wherein a second clip in said plurality of clips is arranged to releasably engage said U-shaped channel and a respective third wall for an eighth channel in said plurality of channels.

17. The screen assembly of claim 1 wherein a third clip in said plurality of retainer clips further comprises a protrusion arranged to engage an installation tool.

18. A screen assembly comprising:

a U-shaped channel;

a plurality of channels, wherein said U-shaped channel and said plurality of channels form a rectangular shape, are arranged to receive a substantially rectangular screen frame, and are arranged for installation in a window frame, wherein each channel in said plurality of channels includes respective first and second walls forming an L-shape and a respective third wall hingedly connected to said respective first wall, said respective first, second, and third walls form a U-shape when said respective third wall is in a closed position, said U-shaped channel and said plurality of channels are arranged to receive said screen frame when said respective third wall is in an open position, and said plurality of channels are arranged to restrain said frame when said respective third wall is in said closed position; and, a plurality of retainer clips arranged to releasably engage said plurality of channels to maintain said respective third wall in said closed position, wherein at least one retainer clip from the plurality of retainer clips is a separate piece from the U-shaped channel and the plurality of channels, wherein each clip from the at least one retainer clip from the plurality of retainer clips is adapted to engage the U-shaped channel and a channel from the plurality of channels or is adapted to engage two channels from the plurality of channels.

* * * * *